US009330518B2

(12) United States Patent
Cha et al.

(10) Patent No.: US 9,330,518 B2
(45) Date of Patent: May 3, 2016

(54) AUTOMATIC TELLER MACHINE AND METHOD TO ALIGN MEDIA THEREOF

(75) Inventors: Jin Hwan Cha, Anyang-si (KR); Woo Ho Lee, Seoul (KR)

(73) Assignee: NAUTILUS HYOSUNG INC., Seoul (KR)

( * ) Notice: Subject to any disclaimer, the term of this patent is extended or adjusted under 35 U.S.C. 154(b) by 370 days.

(21) Appl. No.: 13/557,082

(22) Filed: Jul. 24, 2012

(65) Prior Publication Data

US 2013/0026004 A1 Jan. 31, 2013

(30) Foreign Application Priority Data

Jul. 25, 2011 (KR) ..... 10-2011-0073526

(51) Int. Cl.

*B65H 9/16* (2006.01)
*G07D 11/00* (2006.01)
*B65H 7/02* (2006.01)

(52) U.S. Cl.

CPC ..... *G07D 11/0018* (2013.01); *B65H 7/02* (2013.01); *B65H 9/166* (2013.01); *B65H 2301/314* (2013.01); *B65H 2404/14212* (2013.01); *B65H 2404/40* (2013.01); *B65H 2404/6111* (2013.01); *B65H 2511/216* (2013.01); *B65H 2513/42* (2013.01); *B65H 2701/1912* (2013.01)

(58) Field of Classification Search

CPC ..... B65H 9/004; B65H 9/166; B65H 9/16; B65H 9/101; B65H 9/106
USPC ..... 271/226–228, 248, 250–255
See application file for complete search history.

(56) References Cited

U.S. PATENT DOCUMENTS 2,377,525 A * 6/1945 Schutt ..... 271/274
4,889,240 A * 12/1989 Sato et al. ..... 209/534
8,534,667 B2 * 9/2013 Cha ..... B65H 5/062 271/228
8,695,776 B2 * 4/2014 Cha ..... G07D 11/0018 194/206

(Continued)

FOREIGN PATENT DOCUMENTS

DE 101 17 712 11/2001
EP 0 317 537 5/1989
EP 1 331 185 7/2003

OTHER PUBLICATIONS

Machine translation of Detailed Description of European Publication No. EP 1331185.*

(Continued)

*Primary Examiner* — Thomas Morrison
(74) *Attorney, Agent, or Firm* — Fenwick & West LLP

(57) ABSTRACT

An automatic teller machine (ATM) including a medium receiving portion to receive a paper medium, a medium transfer portion to transfer the paper medium received through the medium receiving portion to a cassette as a storage space, and a medium alignment portion disposed on a transfer path of the medium transfer portion to align the paper medium. The medium alignment portion includes a drum-type alignment body including a transfer path connected to the transfer path of the medium transfer portion so that the paper medium passes through the transfer path in a rotating manner, and including an alignment reference surface to align the paper medium; driving rollers disposed in the alignment body to drive the paper medium forward along the transfer path; and inclined rollers disposed outside of the alignment body corresponding to the driving rollers, and selectively inclined from a transfer direction of the paper medium.

9 Claims, 7 Drawing Sheets

(56) References Cited

U.S. PATENT DOCUMENTS

| | | | | |
|---|---|---|---|---|
| 2010/0283199 | A1 | 11/2010 | Yasumoto | |
| 2010/0327518 | A1* | 12/2010 | Tharayil | 271/227 |
| 2013/0020172 | A1* | 1/2013 | Cha | G07D 11/0081 194/206 |

OTHER PUBLICATIONS

European Patent Office, European Search Report and Opinion, European Patent Application No. 12177256.0, Nov. 7, 2012, five pages.

* cited by examiner

AUTOMATIC TELLER MACHINE AND METHOD TO ALIGN MEDIA THEREOF

CROSS-REFERENCE TO RELATED APPLICATION

This application claims the benefit of Korean Patent Application No. 10-2011-0073526, filed on Jul. 25, 2011, in the Korean Intellectual Property Office, the disclosure of which is incorporated herein by reference.

BACKGROUND

1. Field of the Invention

The present invention relates to an automatic teller machine (ATM) and a media alignment method thereof, and more particularly, to an ATM reduced in size to be easily mounted in an apparatus while accurately aligning a paper medium of different sizes and types, and a media alignment method thereof.

2. Description of the Related Art

Generally, an automatic teller machine (ATM) refers to an automated apparatus providing fundamental monetary services, such as payment and withdrawal of cash and checks, using a card or a bankbook regardless of time and places without a bank teller.

Recently, use of the ATM is not limited to banking facilities such as banks but expanded to convenience stores, department stores, and other public places.

The ATM may be classified into a cash dispenser, a cash receiver, and a cash dispenser and receiver. In these days, the ATM is used for not only payment and withdrawal of cash but also payment and withdrawal of checks, bankbook arrangement, fee payment by giro, ticketing, and the like.

Nowadays, the cash receiver among the foregoing types is applying a technology for receiving different types of paper medium, such as cash and checks, together rather than separately.

A structure of the ATM as the cash receiver will be briefly described. The ATM may include a housing to form a main body, a medium receiving portion to receive a paper medium such as cash and checks, a medium transfer portion including a plurality of rollers to transfer the paper medium received through the medium receiving portion, a medium detection portion mounted on a path of the medium transfer portion to detect whether the paper medium includes double sheets, a medium recognition portion to recognize data of the paper medium, a medium alignment portion to align the paper medium before the paper medium is delivered to the medium recognition portion, a temporary stack portion to temporarily store the received paper medium, a retract portion to retract a non-received paper medium among the paper medium, a reject portion to store a paper medium detected to be abnormal by the medium detection portion and rejected, and a cassette portion to finally store the received paper medium. The cassette may include a cash cassette to store only cash and a check cassette to store only checks.

According to the foregoing structure, the paper medium may be received through the medium receiving portion and transferred to the respective corresponding cassettes, passing through the temporary stack portion by the medium transfer portion.

The medium alignment portion is adapted to align a paper medium of different sizes and types, for example cash and checks having different widths and lengths from each other, with reference to one side so that the paper medium is transferred in an aligned state. In particular, by aligning checks, the medium alignment portion helps correctly acquire data of the checks.

However, in the conventional ATM used as the cash receiver, the medium alignment portion has a flat shape, accordingly occupying a large space in the housing. Furthermore, the paper medium may be folded or creased during alignment. Thus, the alignment may not be reliable.

Accordingly, there is a desire for an improved ATM including a medium alignment structure capable of reliably aligning the paper medium with a reduced size.

SUMMARY

An aspect of the present invention provides an automatic teller machine (ATM) capable of accurately and efficiently aligning a paper medium of different sizes and types, such as cash and checks, and a media alignment method thereof.

Another aspect of the present invention provides an ATM formed in a drum shape with a reduced size to be easily mounted in an apparatus, and a medium alignment method thereof.

Still another aspect of the present invention provides an ATM preventing a paper medium from creasing or tearing, by restricting interference of a driving roller and an inclined roller with respect to the paper medium when aligning the paper medium, and a medium alignment method thereof.

According to an aspect of the present invention, there is provided automatic teller machine (ATM) including a medium receiving portion to receive a paper medium, a medium transfer portion to transfer the paper medium received through the medium receiving portion to a cassette functioning as a storage space, and a medium alignment portion disposed on a transfer path of the medium transfer portion to align the paper medium, wherein the medium alignment portion includes a drum-type alignment body including a transfer path connected to the transfer path of the medium transfer portion so that the paper medium passes through the transfer path in a rotating manner, and including an alignment reference surface for alignment of the paper medium, a plurality of driving rollers disposed in the alignment body to drive the paper medium forward along the transfer path, and a plurality of inclined rollers disposed at an outside of the alignment body to correspond to the plurality of driving rollers, and selectively inclined with respect to a transfer direction of the paper medium. According to the above structure, the ATM may be reduced in size to be easily mounted in an apparatus while accurately aligning a paper medium of different sizes and types.

The medium alignment portion may further include a detection sensor to detect whether the paper medium is aligned, by detecting a position of the paper medium which is passing along the transfer path of the alignment body by interaction between the plurality of driving rollers and the plurality of inclined rollers.

The plurality of driving rollers may be partially exposed through holes formed through the alignment body, and uniformly mounted along a circumference of the alignment body to contact the paper medium, and the plurality of inclined rollers may be uniformly mounted at an outside along the circumference of the alignment body to partially contact the plurality of driving rollers.

The medium alignment portion may further include inclination adjustment portions connected to the plurality of inclined rollers, respectively, to adjust an inclination of the plurality of inclined rollers with respect to the transfer direction of the paper medium.

The inclination adjustment portion may include a mounting member to which the plurality of inclined rollers are rotatably mounted, including a rotational shaft, and a rotational driving member to axially rotate the mounting member with respect to the rotational shaft so as to adjust the inclination of the plurality of inclined rollers with respect to the transfer direction of the paper medium.

The inclination of the plurality of inclined rollers may be adjusted to be the same as an orientation of the plurality of driving rollers after the paper medium is completely aligned while passing through the alignment body.

The ATM may further include a gate disposed at a connection part between an exit of the medium alignment portion and the medium transfer portion to determine the transfer direction of the paper medium, wherein the gate may be switched to allow the paper medium to be transferred to the medium transfer portion when the detection sensor detects an aligned state of the paper medium, and switched so that the paper medium rotates around the alignment body again when the detection sensor detects a non-aligned state of the paper medium.

The medium alignment portion may perform alignment of one paper medium, transfer the aligned paper medium to the transfer path of the medium transfer portion, and then perform alignment of another paper medium.

The alignment body may include a first body formed in a drum shape, through which the paper medium is passed in a rotating manner and in which the plurality of driving rollers are mounted, and a second body disposed at one side of the first body and formed to have a greater diameter than the first body, of which a surface directed to the first body is defined as the alignment reference surface.

The first body may be fixed to the housing while the second body is rotatable with respect to the first body corresponding to a driving speed of the paper medium.

The alignment reference surface may include a plurality of grooves formed along a circumference of the alignment reference surface to prevent folding of one side of the paper medium which contacts the alignment reference surface.

According to another aspect of the present invention, there is provided a medium alignment method of the ATM, the medium alignment method including aligning to introduce the paper medium into the medium alignment portion through the medium transfer portion and to align the paper medium by operation of the plurality of driving rollers and the plurality of inclined rollers, alignment detecting to detect whether the paper medium is aligned using the detection sensor, and discharging to discharge the paper medium from the medium alignment portion and transfer the paper medium to the medium transfer portion when the paper medium is detected to be aligned in the alignment detecting.

The medium alignment portion may include inclination adjustment portions connected to the plurality of inclined rollers, respectively, to adjust an inclination of the plurality of inclined rollers with respect to the transfer direction of the paper medium, and the inclination of the plurality of inclined rollers may be adjusted to be the same as an orientation of the plurality of driving rollers by the inclination adjustment portion when the paper medium is detected to be aligned in the alignment detecting.

The paper medium may be rotated along the transfer path of the alignment body and aligned again when the paper medium is detected to be not aligned by the detection sensor in the alignment detecting.

According to embodiments of the present invention, accurate alignment of a paper medium is achieved. Therefore, an automatic teller machine (ATM) may efficiently align a mixed paper medium such as cash and checks having different sizes and types.

Additionally, according to embodiments of the present invention, the ATM may be formed as a drum with a reduced size to be efficiently mounted in an apparatus.

Additionally, according to embodiments of the present invention, the ATM may restrict interference of a driving roller and an inclined roller with respect to the paper medium when the paper medium is aligned by interaction of the driving roller and the inclined roller, thereby preventing the paper medium from creasing or tearing.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Hereinafter, structure and application of embodiments of the present invention will be described in detail with reference to the accompanying drawings. The following description illustrates one of various aspects of the present invention and constitutes part of a detailed description about the present invention.

However, in explaining the embodiments of the present invention, generally known functions and structures will not be explained in detail for conciseness.

In the following description, an automatic teller machine (ATM) will be described as a cash receiver that receives a paper medium such as cash and checks. However, technical aspects of the present invention are applicable to other types of ATM such as a combined cash receiver and dispenser.

Figure 1:
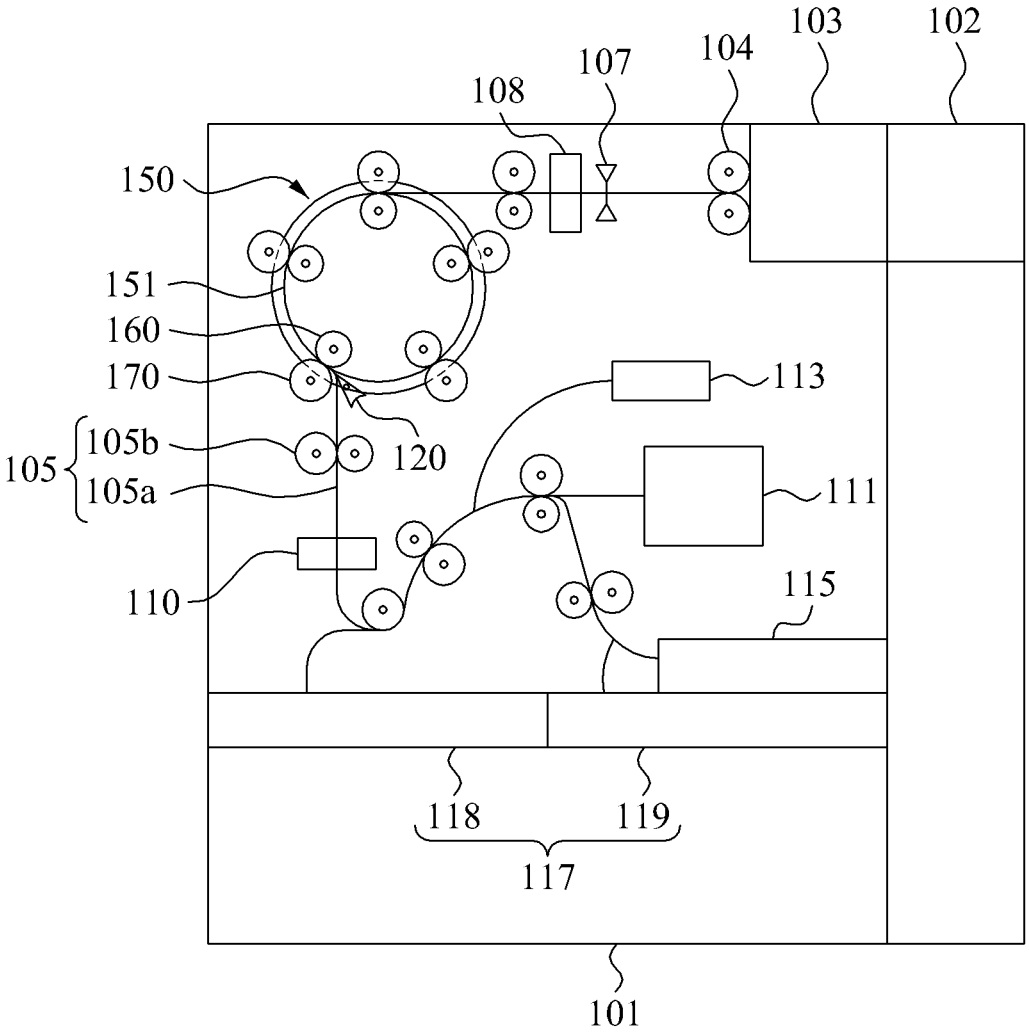
FIG. 1 is a view illustrating a structure of an automatic teller machine (ATM) according to an embodiment of the present invention.
Figure 2:
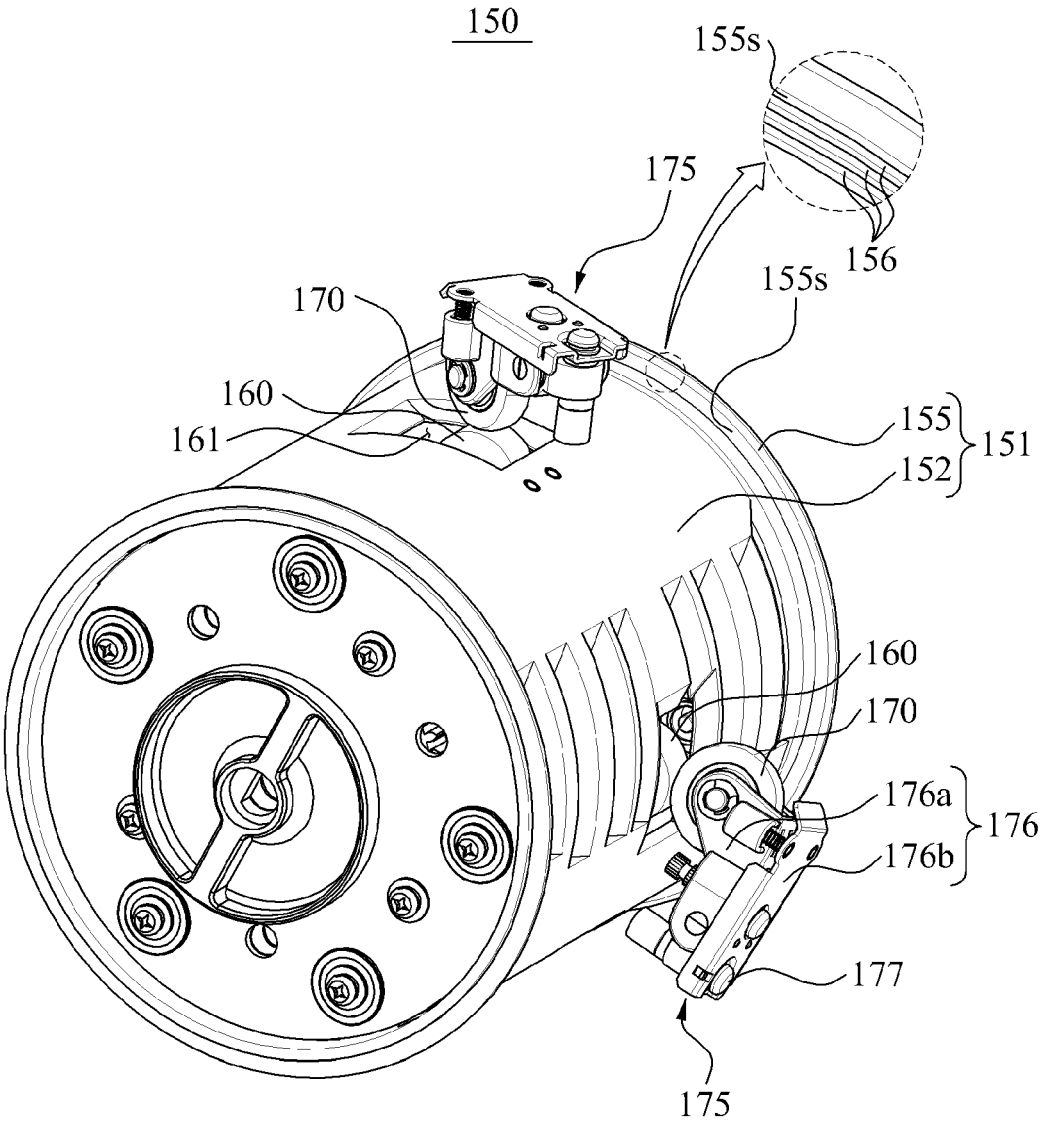
FIG. 2 is a partially exploded and perspective view illustrating a medium alignment portion shown in FIG. 1.
Figure 3:
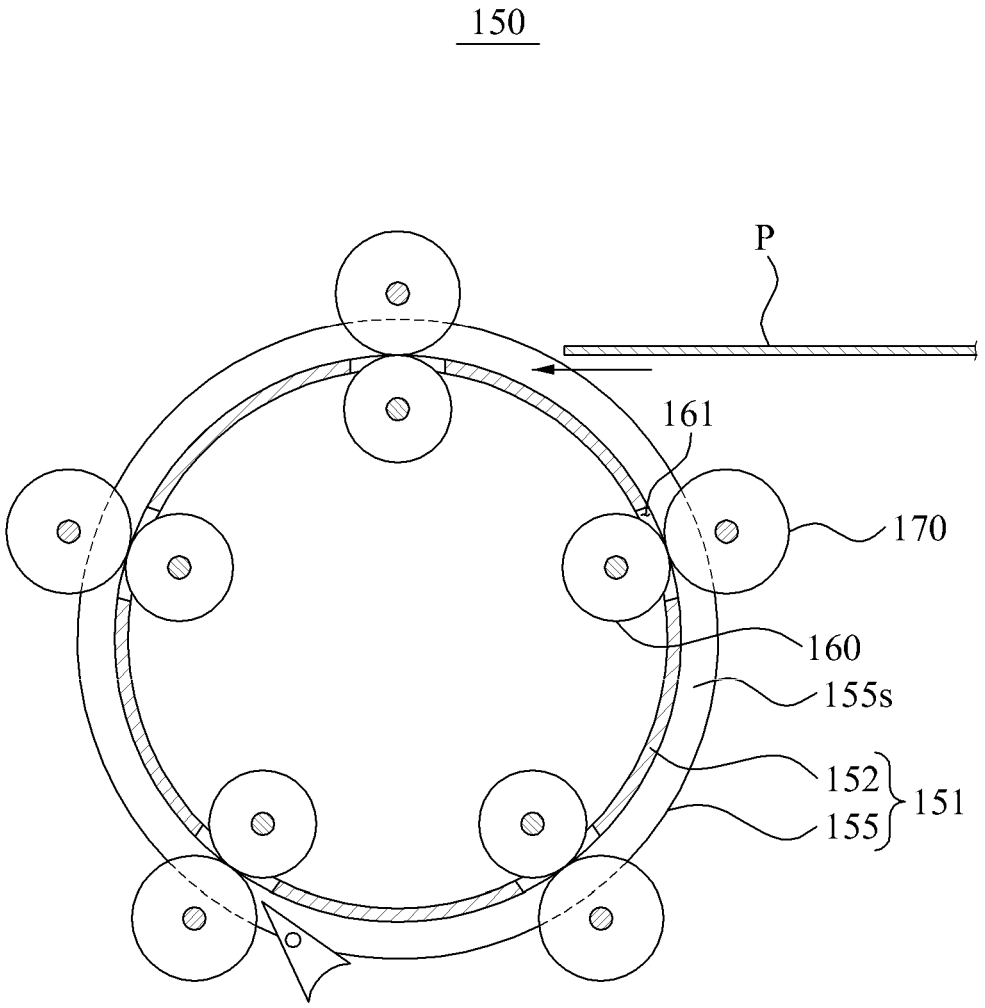
FIG. 3 is a vertical sectional view of FIG. 2.
Figure 4:
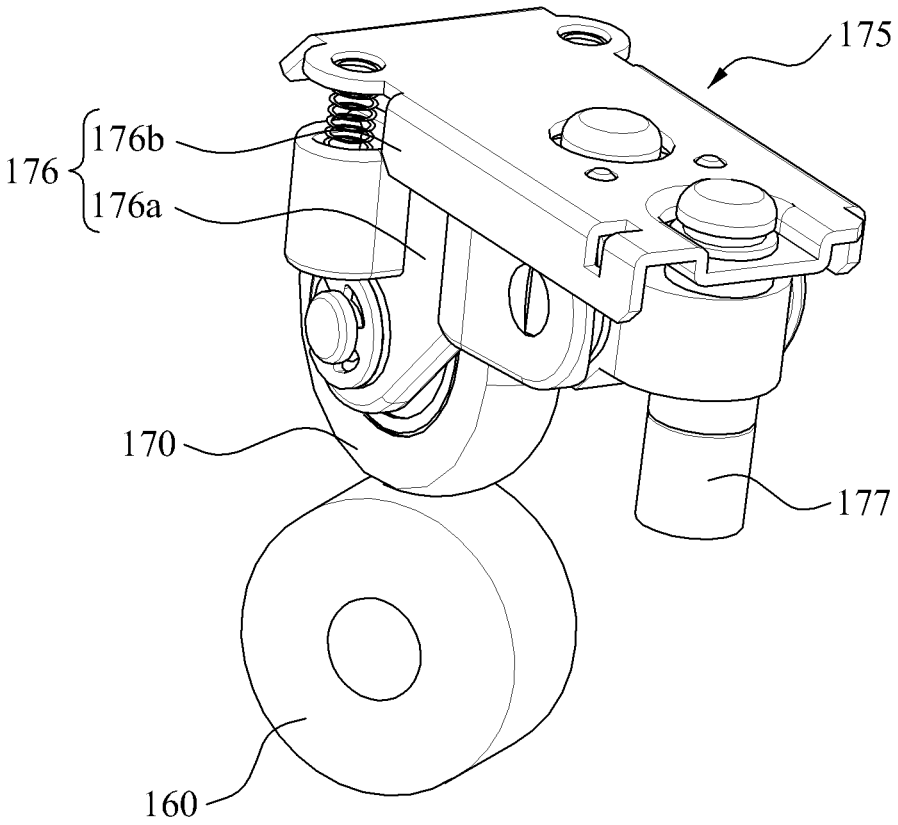
FIG. 4 is an enlarged view illustrating an arrangement state of a driving roller and an inclined roller shown in FIG. 2.
Figure 5:
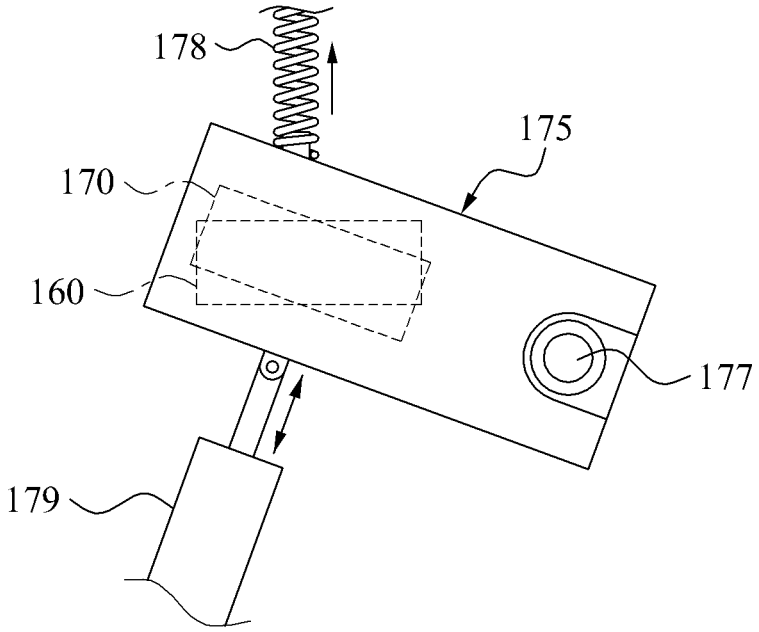
FIG. 5 is a view illustrating an inclination of the inclined roller being adjusted by an inclination adjustment portion shown in FIG. 4.

FIG. 1 is a view illustrating a structure of an ATM 100 according to an embodiment of the present invention. FIG. 2 is a partially exploded and perspective view illustrating a medium alignment portion 150 shown in FIG. 1. FIG. 3 is a vertical sectional view of FIG. 2. FIG. 4 is an enlarged view illustrating an arrangement state of a driving roller 160 and an inclined roller 170 shown in FIG. 2. FIG. 5 is a view illustrating an inclination of the inclined roller 170 being adjusted by an inclination adjustment portion 175 shown in FIG. 4. FIG.

Figure 6:
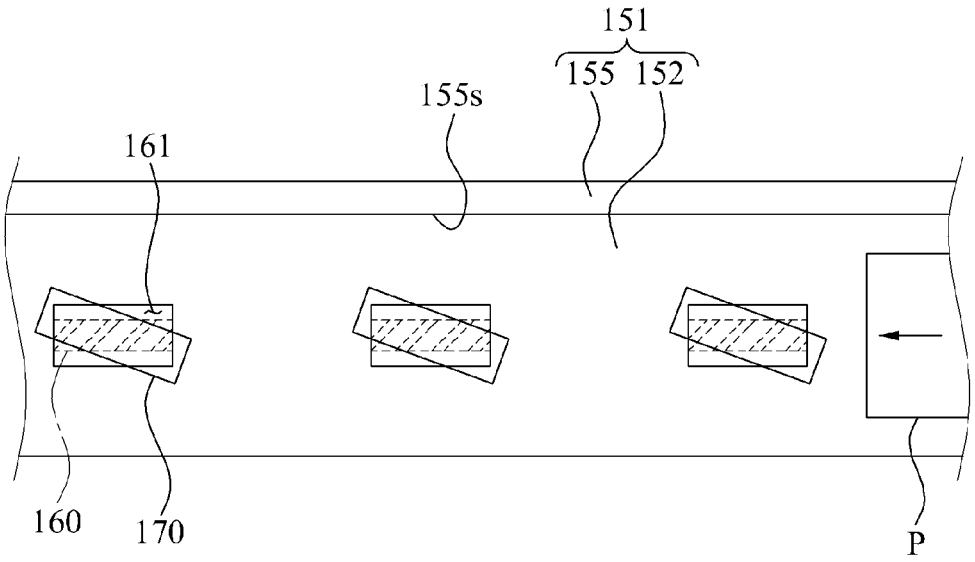
FIG. 6 is a view illustrating the inclined roller in a state where a paper medium is introduced to a starting portion of an alignment body of the medium alignment portion shown in FIG. 2, the alignment body illustrated as an imaginary plane.
Figure 7:
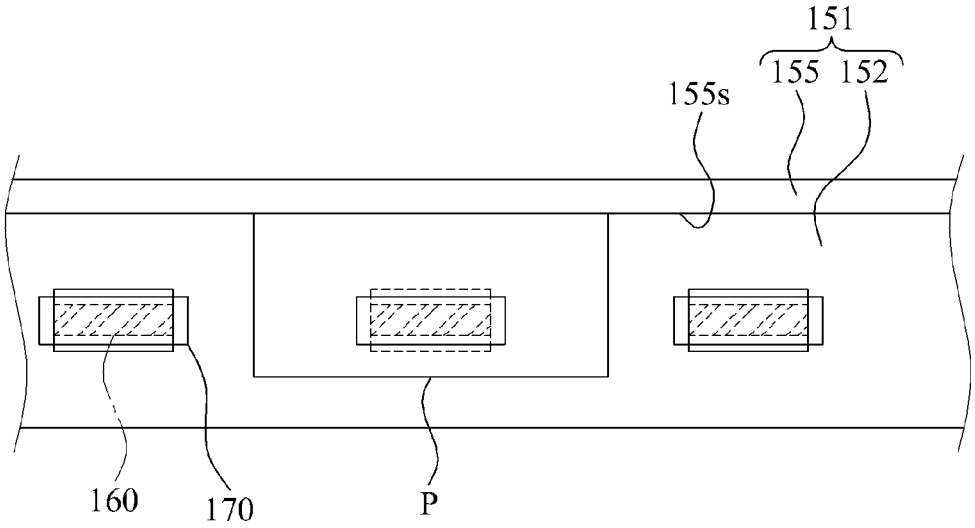
FIG. 7 is a view illustrating a change in an angle of the inclined roller after alignment is completed by the driving roller and the inclined roller as shown in FIG. 6.

6 is a view illustrating the inclined roller 170 in a state where a paper medium P is introduced to a starting portion of an alignment body 151 of the medium alignment portion 150 shown in FIG. 2, the alignment body 151 illustrated as an imaginary plane. FIG. 7 is a view illustrating a change in an angle of the inclined roller 170 after alignment is completed by the driving roller 160 and the inclined roller as shown in FIG. 6.

Referring to FIG. 1, the ATM 100 includes a housing 101, a medium receiving portion 102 mounted to one side of the housing 101 to receive the paper medium P, a medium separation portion 103 to separate the paper medium P received through the medium receiving portion 102 into individual sheets and transfer the separated paper medium P, a medium transfer portion 105 to form a transfer path for the paper medium P from a tail end of the medium separation portion 103, a medium detection portion 107 mounted on the transfer path of the medium transfer portion 105 to detect whether the paper medium P transferred from the medium separation portion 103 to the medium transfer portion 105 includes double sheets, a medium recognition portion 108 to recognize whether the paper medium P is cash or a check, the medium alignment portion 150 disposed on the transfer path of the medium transfer portion 105 to align the paper medium P, a check recognition portion 110 to recognize data of checks among the paper medium P, a temporary stack portion 111 to temporarily store a paper medium P determined to be normal as a recognition result of the medium recognition portion 108 and the check recognition portion 110, a reject portion 113 to store a paper medium P determined to be abnormal and rejected as the recognition result of the medium recognition portion 108 and the check recognition portion 110, a retract portion 115 to retract a paper medium P determined to be collected as the recognition result of the medium recognition portion 108 and the check recognition portion 110, and cassettes 117 to finally store the cash and checks.

The respective elements will be described. The housing 101 constitutes an appearance of the ATM 100. The housing 101 includes the medium receiving portion 102 disposed at one side, the cassettes 117 built in a lower space, and the other foregoing elements disposed in an inner space. However, configuration of the housing 101 is not limited to the foregoing embodiment.

Through the medium receiving portion 102, a customer directly puts in the paper medium P. The medium receiving portion 102 according to the present embodiment does not separately include a cash receiving path and a check receiving path but is configured to receive cash and checks together. That is, the customer may put random combination of cash and checks as the paper medium P in the medium receiving portion 102. The paper medium P including the cash and checks may be separated by structures to be described later and transferred to the respective cassettes 117.

The medium separation portion 103 may receive the paper medium P, for example in a bundle, from the medium receiving portion 102 and deliver the paper medium P sheet by sheet to a starting position of the medium transfer portion 105. For this, the medium separation portion 103 may include rollers 104 to separate the paper medium sheet by sheet.

The medium transfer portion 105, forming a path for transfer of the paper medium P, may include a plurality of transfer paths. Referring to FIG. 1, the medium transfer portion 105 may include a path connecting the medium separation portion 103, the medium alignment portion 150, and a temporary stack portion 111, and a path for transfer of the paper medium P stored in the temporary stack portion 111 to the cassettes 117. Additionally, the medium transfer portion 105 may form a transfer path for transfer of the paper medium P detected to be abnormal to the reject portion 113 and a transfer path for transfer of the paper medium P determined to be forged or not received to the retract portion 115.

The medium transfer portion 105 may include a belt 105*a* circulating in a predetermined direction while providing a holding force to the paper medium P, and a plurality of rollers 105*b* supporting and driving the belt 105*a*.

As shown in FIG. 1, the medium detection portion 107 may be mounted on the transfer path of the medium transfer portion 105 between the medium separation portion 103 and the medium alignment portion 150. The medium detection portion 107 may detect whether the paper medium P transferred from the medium separation portion 103 to the medium transfer portion 105 includes a single sheet. That is, the medium detection portion 107 may detect a thickness change of the paper medium P transferred by the medium transfer portion 105, thereby accurately determining whether the paper medium P includes a single sheet. An ultrasonic sensor may be used as the medium detection portion 107 but this is only by way of example.

The medium recognition portion 108 may be mounted to a tail end of the medium detection portion 107 to recognize whether the paper medium P is cash or a check. When the paper medium P is recognized as cash, the medium recognition portion 108 may identify a cash type and even a forged bill. The medium recognition portion 108 may include a contact image sensor (CIS) image scanner, an infrared (IR) sensor, a (MR) sensor, and an ultraviolet (UV) sensor. As aforementioned, with respect to the cash, even a forged bill may be recognized. However, with respect to the check, only whether the paper medium P is a check may be determined using a check image.

The check recognition portion 110 may recognize a check from the paper medium P aligned by the medium alignment portion 150. Although not shown, the check recognition portion 110 may include magnetic ink character recognition (MICR) to correctly recognize data recorded on the check.

In further details, the MICR of the check recognition portion 110 may identify whether the check is a forged paper medium P, that is, a forged bill, by recognizing a magnetic ink character of the check among the paper medium P. Whether the paper medium P is forged may be correctly determined through the check image obtained by the medium recognition portion 108 and check data obtained by the MICR of the check recognition portion 110.

Here, for correct recognition of the check among the paper medium P by the check recognition portion 110, the paper medium P needs to be in the aligned state when passing through the transfer path of the medium transfer portion 105 to which the check recognition portion 110 is mounted. The alignment may be performed by the medium alignment portion 150 that will be described later.

The reject portion 113 may be provided in a cassette type to store the paper medium P determined to be rejected by the medium recognition portion 108 and transferred. The reject portion 113 may be removably connected to the housing 101.

The temporary stack portion 111 may be a box to temporarily store a paper medium P recognized to be normal by the medium recognition portion 108. The reason for temporarily storing the paper medium P in the temporary stack portion 111 is to collect the single sheet of the paper medium P and handle the paper medium P in a bundle, thereby increasing cash receiving efficiency. Although not shown, the temporary stack portion 111 may include a drum and a band. Therefore, the temporary stack portion 111 may temporarily store the paper medium P by winding the paper medium P on the drum or the band rather than by stacking the paper medium P. However, the configuration of the temporary stack portion 111 is not limited to the foregoing structure.

Although not shown, a printer (not shown) may be mounted on the transfer path of the medium transfer portion 105 disposed between the check recognition portion 110 and the temporary stack portion 111. The printer may print the data recorded on the check among the paper medium P recognized by the check recognition portion 110.

As shown in FIG. 1, the retract portion 115 may be disposed at an end of a transfer path branched from the transfer path of the medium transfer portion 105 disposed between the check recognition portion 110 and the temporary stack portion 111, to collect a non-received paper medium P among the paper medium P. In the same manner as the reject portion 113, the retract portion 115 may also be a cassette type and removably mounted to the housing 101.

As shown in FIG. 1, the cassettes 117 may be connected to the temporary stack portion 111 by transfer paths formed by the medium transfer portion 105, respectively. The cassettes 117 may include a cash cassette 118 to store cash and a check cassette 119 to store checks.

Based on the data recognized by the medium recognition portion 108 and the check recognition portion 110, a control portion (not shown) of the ATM 100 may obtain storage order information of the paper medium P to be temporarily stored in the temporary stack portion 111. According to the storage order information, the paper medium P may be transferred from the temporary stack portion 111 to the cash cassette 118 or the check cassette 119. Accordingly, the cash cassette 118 may store the paper medium P corresponding to the cash while the check cassette 119 stores the paper medium P corresponding to the checks.

As described above, the ATM 100 according to the embodiment is configured such that the paper medium P received through the medium receiving portion 102 is stored in the cassettes 117 through several routes. Here, unless the paper medium P is accurately aligned by the medium alignment portion 150, the data recoded on the paper medium P may be incorrectly recognized, thereby causing an error during reception of the paper medium P. Also, when the paper medium P is moved in a non-aligned state, the paper medium P may be creased or torn. In this case, the operation of the ATM 100 may stop.

Therefore, the medium alignment portion 150 may include a structure for accurately aligning the paper medium P.

The structure will be described in detail. As shown in FIGS. 2 to 4, the medium alignment portion 150 may include the alignment body 151 providing a transfer path through which the paper medium P is passed and aligned and including an alignment reference surface 155*s* functioning as a reference of alignment, a plurality of driving rollers 160 disposed in the alignment body 151 to drive the paper medium P forward along the transfer path, a plurality of inclined rollers 170 disposed at an outside of the alignment body 151 to correspond to the plurality of driving rollers 160 and selectively inclined with respect to a transfer direction of the paper medium P, the inclination adjustment portion 175 to adjust an inclination of the plurality of inclined rollers 170, and a detection sensor (not shown) to detect an aligned state of the paper medium P.

According to the structure of the medium alignment portion 150, the paper medium P may be aligned with respect to the alignment reference surface 155*s* regardless of size and type. Therefore, recognition of the paper medium P by the medium recognition portion 108 and the check recognition portion 110 may be correctly performed. Also, the paper medium P accurately aligned may be prevented from creasing or folding during transfer. As a result, unexpected stoppage of the ATM 100 may be prevented.

In further details, as aforementioned, the paper medium P randomly including cash and checks may be received through the medium receiving portion 102 of the ATM 100. Since the cash and the checks are in different sizes, the paper medium P including the cash and the checks need to be aligned with reference to one side. This is because the medium recognition portion 108 and the check recognition portion 110 are mounted under the presumption that the paper medium P is aligned with reference to one side. When the paper medium P is not accurately aligned, abnormality of the paper medium P may not be correctly recognized. Also, data of the check may not be correctly recognized.

However, as will be described later, the medium alignment portion 150 according to the present embodiment may accurately align the paper medium P including the cash and the checks with respect to one side of the paper medium P, that is, the alignment reference surface 155*s*, thereby solving the aforementioned limits.

The respective parts will be described. First, the alignment body 151 forming an appearance of the medium alignment portion 150 may include a first body 152 provided in a drum shape through which the paper medium P passes in a rotating manner, and a second body 155 disposed at one side of the first body 152 and formed to have a greater diameter than the first body 152. A surface of the second body 152 directed to the first body 152 may be defined as the alignment reference surface 155*s*.

As shown in FIGS. 2 and 3, the plurality of driving rollers 160 may be mounted to the first body 152. The first body 155 may include holes 161 to partially expose the plurality of driving rollers 160 to the outside. Therefore, when the paper medium P is transferred to an outer surface of the first body 152, the paper medium P may be driven, that is, transferred in one direction by rotation of the driving rollers 160. The first body 152 may have a circumference a bit longer than a length of one sheet of the paper medium P so that alignment of one sheet of the paper medium P is achieved by the medium alignment portion 150. However, not limited thereto, the first body 152 may be configured so that plural sheets of the paper medium P are sequentially introduced in the medium alignment portion 150 and aligned.

The driving rollers 160 may be five in number, being mounted along an inner circumference of the first body 152 as simply shown in FIG. 3. Therefore, when the paper medium P is moved on the first body 152 along the driving rollers 160, suspension of movement of the paper medium P may be prevented. Here, the number of the driving rollers 160 is not limited but may be greater or less than five.

The driving rollers 160 may be rotated by respectively corresponding driving motors (not shown). Accordingly, the driving rollers 160 may be rotated at almost the same speed as one another when driving the paper medium P in one direction. As a result, creasing of the paper medium P that may be caused by different speeds among the driving rollers 160 may be prevented. Although the driving rollers 160 are described to be independently driven by the respective driving motors in the present embodiment, the structure is not limiting. That is, the plurality of driving rollers 160 may be driven by a single driving motor.

As shown in FIGS. 2 and 3, the second body 155 is disposed at a side of the first body 152, providing the alignment reference surface 155*s*. That is, a side of the second body 155 directed to the first body 152 serves as the alignment reference surface 155*s*. Therefore, the paper medium P may be aligned with reference to the alignment reference surface 155*s* during transfer and therefore transferred to a next step in the aligned state.

Whereas the first body 152 is fixed to an inside of the housing 101, the second body 155 is rotatable with respect to the first body 152. According to such a structure, when the paper medium P aligned by the alignment reference surface 155*s* of the second body 155 and then driven by the driving rollers 160, creasing or tearing of the paper medium P may be prevented.

After the paper medium P is aligned, the paper medium P stays in contact with the alignment reference surface 155*s* of the second body 155. Here, since the second body 155 rotates with respect to the first body 152 at almost the same speed as a speed of the paper medium P driven by the driving rollers 160, friction may be prevented from generating between the paper medium P and the alignment reference surface 155*s*. As a result, creasing or tearing of the paper medium P may be prevented.

Furthermore, as shown in the partial enlarged view of FIG. 2, a plurality of grooves 156 may be formed in the form of bands along a circumference of the alignment reference surface 155*s*. When the paper medium P is aligned with respect to the alignment reference surface 155*s*, the grooves 156 may prevent folding of one side of the paper medium P which first touches the alignment reference surface 155*s*. Consequently, reliability in the alignment may be increased.

The plurality of inclined rollers 170 may be disposed at the outside of the alignment body 151 to correspond to the plurality of driving rollers 160, respectively, as shown in FIG. 3. Different from the driving rollers 160 rotated in the transfer direction of the paper medium P, the inclined rollers 170 may be rotated in a direction inclined from the transfer direction of the paper medium P.

That is, the inclined rollers 170 may push the paper medium P against the alignment reference surface 155*s* of the second body 155 so that the paper medium P being driven by the driving rollers 160 is moved to one side, that is, the alignment reference surface 155*s*. Thus, the inclined rollers 170 may actually perform alignment of the paper medium P.

The inclined rollers 170 may partially contact with an outer surface of the driving rollers 160 and therefore rotate in a direction opposite to a rotation direction of the driving rollers 160 as the driving rollers 160 rotate. By a rotational force, the inclined rollers 170 may push the paper medium P toward the alignment reference surface 155*s* of the second body 155. However, the inclined rollers 170 may each be provided with a driving portion to rotate the inclined rollers.

When the inclined rollers 170 continues pushing the paper medium P being driven by the driving rollers 160 in the inclined direction, for example, when the inclined rollers 170 continues pushing even after the paper medium P is aligned with respect to the alignment reference surface 155*s*, interference may be caused between the paper medium P and the alignment reference surface 155*s*, thereby creasing the paper medium P.

To prevent the foregoing situation, the medium alignment portion 150 may include a plurality of detection sensors (not shown) to detect a position of the paper medium P, thereby detecting whether the paper medium P is aligned, and the inclination adjustment portion 175 to adjust the inclination of the inclined rollers 170 based on information detected by the detection sensors.

At least one of the plurality of detection sensors may be adapted to detect whether the paper medium P is aligned with respect to the alignment reference surface 155*s* of the alignment body 151. The at least one detection sensor may be mounted adjacent to the alignment body 155 where the alignment reference surface 155*s* is formed, to obtain detected information related to the alignment and transmit relevant information to the control portion (not shown) so that the control portion (not shown) adjusts the inclination of the inclination adjustment portion 175.

At least two detection sensors (not shown) of the plurality of detection sensors may be mounted collinearly on the first body 152 and orthogonally to the transfer direction of the paper medium P. The at least two detection sensors (not shown) may detect whether the paper medium P is aligned, by detecting a skew angle of the paper medium P being transferred. In addition, information detected by the at least two detection sensors (not shown) may be transmitted to the control portion (not shown) so that the inclination is adjusted by the inclination adjustment portion 175 that will be described later.

Here, width of the at least two detection sensors (not shown) detecting the skew angle of the paper medium P may be smaller than a smallest width of the paper medium P passing through the medium alignment portion 150. Therefore, the aligned state of all the paper medium P passing through the medium alignment portion 150 may be correctly recognized.

Referring to FIG. 2, the inclination adjustment portion 175 may include a mounting member 176 to which the inclined rollers 170 are rotatably mounted and including a rotational shaft 177, and a rotational driving member 179 to rotate the mounting member 176 about the rotational shaft 177 and thereby adjust the inclination of the inclined rollers 170 with respect to the transfer direction of the paper medium P. Although a mounting structure of the inclination adjustment portion 175 is not specifically shown, a body (not shown) may be provided to enclose an outside of the alignment body 151 and the inclination adjustment portion 175 coupled with the inclined rollers 170 may be connected to the body (not shown) to be able to operate.

The mounting member 176 may include a first part 176*a* to which the inclined rollers 170 are rotatably mounted, and a second part 176*b* to which the first part 176*a* is connected to be elastically supported and the rotational shaft 177 is rotatably connected. Since the first part 176*a* is connected to the second part 176*b* to be elastically supported, application of an excessive force to the paper medium P may be prevented when the paper medium P passes through between the driving rollers 160 and the inclined rollers 170. As a result, transfer of the paper medium P may be efficiently performed.

As shown in FIG. 5, an elastic member 178 may be connected to one side surface of the mounting member 176, which is directed to the alignment reference surface 155*s*. The mounting member 176 may be pulled toward the alignment reference surface 155*s* by an elastic force of the elastic member 178. Therefore, unless a rotational driving member 179 that will be described later is separately driven, the inclined rollers 170 may be arranged in the inclined direction with respect to the driving rollers 160. Therefore, basically, the inclined rollers 170 may push the paper medium P in the inclined direction, that is, a direction toward the alignment reference surface 155*s*.

Owing to the elastic member 178 mounted to the mounting member 176, the rotational driving member 179 may not be necessarily driven during initial alignment of the paper medium P. Accordingly, power consumption caused by driving may be reduced.

When the paper medium P is brought into contact with the alignment reference surface 155*s*, the detection sensors may detect completion of alignment and, based on the detected information, the inclination of the inclined rollers 170 may be adjusted. The inclination adjustment is performed by the rotational driving member 179.

The rotational driving member 179 may adjust the inclination of the inclined rollers 170 rotatably mounted to the mounting member 176, by rotating the mounting member 176 about the rotational shaft 177. As shown in FIG. 5, the rotational driving member 179 may be connected to an opposite side to the elastic member 178 with respect to the mounting member 176. The rotational driving member 179 may be provided in a solenoid type that adjusts intensity of a magnetic field by controlling intensity of a current applied to the rotational driving member 179. Accordingly, the inclination of the mounting member 176 to which the inclined rollers 170 are mounted may be minutely adjusted.

As shown in FIG. 6, when the paper medium P introduced in the medium alignment portion 150 have yet to be aligned and therefore the detected information is not yet generated by the detection sensors, the inclination alignment portion 175 may adjust the inclined rollers 170 to be inclined with respect to the driving rollers 160. Therefore, the paper medium P may be moved toward the alignment reference surface 155*s* of the alignment body 151 while passing through between the driving rollers 160 and the inclined rollers 170.

Conversely, as shown in FIG. 7, when the paper medium P introduced in the medium alignment portion 150 is aligned while passing through between the driving rollers 160 and the inclined rollers 170 and accordingly the detected information is generated by the detection sensors, the inclination adjustment portion 175 may rotate the inclined rollers 170 so that the inclined rollers 170 are almost in the same direction as the driving rollers 160, thereby preventing interference between the paper medium P and the alignment reference surface 155*s*.

Referring to FIGS. 1 and 3, a gate 120, of which direction is switchable, may be mounted at a connection part between an exit of the medium alignment portion 150 and the medium transfer portion 105. The gate 120 is adapted to determine the transfer direction of the paper medium P.

When the detection sensors detect an aligned state of the paper medium P, the gate 120 may be switched to allow the paper medium P to be transferred to the medium transfer portion 105. When the detection sensors detect a non-aligned state of the paper medium, the gate 120 may be switched so that the paper medium P rotates around the alignment body 151 again.

Thus, the medium alignment portion 150 according to the present embodiment may accurately and efficiently align the paper medium P even in different sizes and types such as cash and checks. In addition, since the medium alignment portion 150 is a small drum type, installment in an apparatus may be convenient. Furthermore, the paper medium P may be smoothly transferred by interaction of the driving rollers 160 and the inclined rollers 170 without creasing or tearing.

Hereinafter, a medium alignment method of the ATM 100 structured as aforementioned will be described with reference to FIG. 8.

Figure 8:
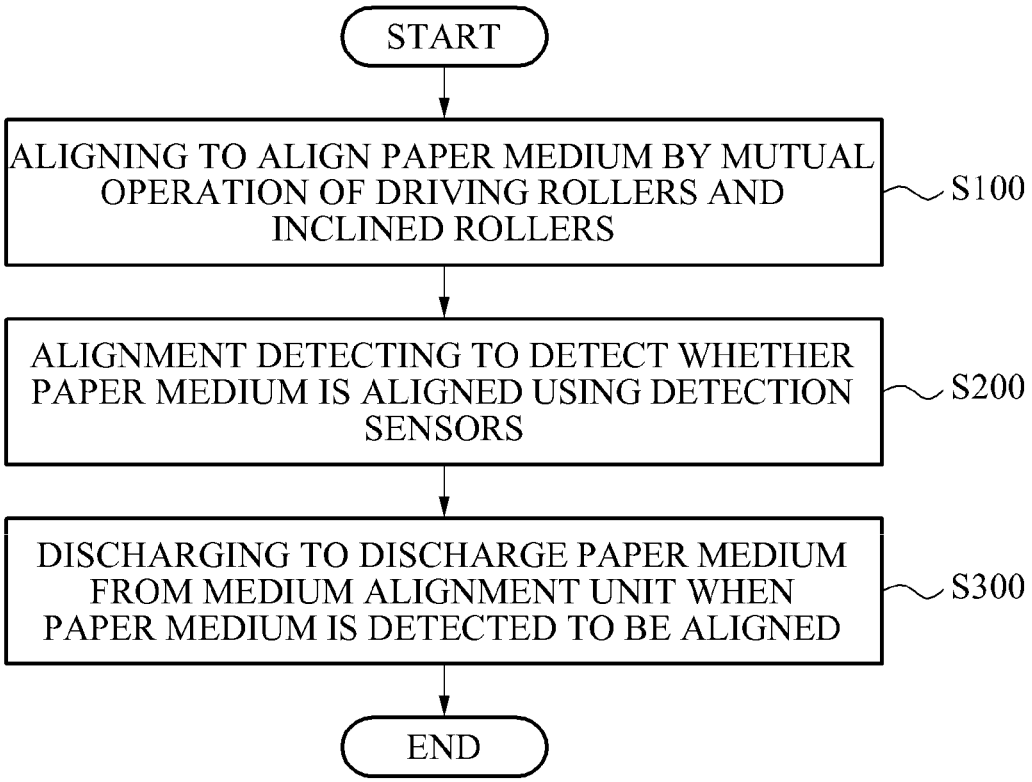
FIG. 8 is a flowchart illustrating a medium alignment method of an ATM according to an embodiment of the present invention.

FIG. 8 is a flowchart illustrating a medium alignment method of an ATM according to an embodiment of the present invention.

The medium alignment method of the ATM 100 may include aligning S100 to introduce a paper medium P into a medium alignment portion 150 through a medium transfer portion 105 and to align the paper medium P by operation of driving rollers 160 and inclined rollers 170, alignment detecting S200 to detect whether the paper medium P is aligned using detection sensors, and discharging S300 to transfer the paper medium P from the medium alignment portion 150 to the medium transfer portion 105 when the paper medium P is detected to be aligned.

As described above, the aligning S100 may be performed in such a manner that the inclined rollers 170 transfer the paper medium P toward an alignment reference surface 155*s* of an alignment body 151 when the paper medium P is driven in a transfer direction by the driving rollers 160.

Whether the paper medium P is aligned may be detected by the detection sensors during the aligning S100. When the aligned state of the paper medium P is detected, an inclination of the inclined rollers 170 may be adjusted by the alignment adjustment portion 175 to be parallel with the driving rollers 160.

Next, when it is confirmed that alignment of the paper medium P is completed at the medium alignment portion 150, the gate 120 may be switched to a direction for discharging the paper medium P from the medium alignment portion 150. Therefore, the paper medium P may be transferred from the medium alignment portion 150 to the medium transfer portion 105 during the discharging S300.

However, when the detection sensors detect that the paper medium P is not aligned, during the alignment detecting S200, the gate 120 may be switched so that the paper medium P is rotated the transfer path of the alignment body 151 and aligned again.

Thus, according to the medium alignment method, the paper medium P may be aligned with respect to the alignment reference surface 155*s* regardless of the sizes and types, and then transferred to the medium transfer portion 105. Here, the inclination adjustment portion 175 may properly adjust the inclination of the inclined rollers 170 according to the detected information of the detection sensors. Therefore, creasing or tearing of the paper medium P during the alignment may be prevented.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. An automatic teller machine (ATM) comprising a medium alignment portion to align a paper medium, the medium alignment portion comprising:

an alignment body having:

a first body of a drum shape of a first diameter and having an outer surface that provides a transfer path of the paper medium, and a second body having a second diameter greater than the first diameter and rotatably mounted to one end of the first body, a surface of the second body facing the first body forming an alignment reference surface for alignment of the paper medium, the second body driven to rotate relative to the first body so that a linear speed of the alignment reference surface coincides with a speed at which the paper medium is transferred to the medium alignment portion;

a plurality of driving rollers disposed within the first body of the alignment body to move the paper medium along the transfer path;

a plurality of inclined rollers disposed outside of the alignment body, the paper medium fed between each of the inclined rollers and a corresponding driving roller of the plurality of driving rollers to move along the transfer path, a rotating axis of each of the inclined rollers configured to form an angle with respect to a rotating axis of the corresponding driving roller to move the paper medium towards the alignment reference surface with the rotation of the inclined rollers and the corresponding driving rollers; and a plurality of inclination adjustment portions, each of the inclination adjustment portions connected to one of the plurality of inclined rollers and rotatable by a rotating driving member to adjust one of the angles, each rotating driving member driving one of the inclination adjustment portions in a first direction and in a second direction opposite to the first direction.

2. The automatic teller machine (ATM) of claim 1, further configured to detect a position of the paper medium transferred along the transfer path by the driving rollers and the inclined rollers and determine whether the paper medium is aligned.

3. The automatic teller machine (ATM) of claim 1, wherein each of the plurality of driving rollers is partially exposed by one of through holes formed on the alignment body to come into contact with the paper medium, and the plurality of driving rollers are evenly spaced around a circumference of the alignment body, and the plurality of inclined rollers are evenly spaced around the circumference of the alignment body to respectively come into contact with the plurality of driving rollers.

4. The automatic teller machine (ATM) of claim 1, wherein each of the inclination adjustment portions comprises:

a mounting member to which a respective inclined roller is rotatably mounted, the mounting member including a rotational shaft.

5. The automatic teller machine (ATM) of claim 4, wherein, after aligning the paper medium on the transfer path, orienting each of the plurality of inclined rollers in a same direction as a corresponding driving roller.

6. The automatic teller machine (ATM) of claim 2, further comprising a gate disposed at a connection part between an exit of the medium alignment portion and the transfer path to determine a transfer direction of the paper medium, wherein the gate is configured to allow the paper medium to be transferred to the transfer path when the paper medium is determined to be in an aligned state, while allowing the paper medium to be transferred along the transfer path in a rotating manner around the alignment body when the detection sensor determines that the paper medium is in a non-aligned state.

7. The automatic teller machine (ATM) of claim 1, wherein the medium alignment portion aligns another paper medium after the paper medium is aligned and transferred to the transfer path.

8. The automatic teller machine (ATM) of claim 1, wherein the second body is rotatably mounted to the first body and configured to rotate with respect to the first body with a speed corresponding to the speed of the paper medium transferred to the medium alignment portion.

9. The automatic teller machine (ATM) of claim 1, wherein the alignment reference surface comprises a plurality of grooves extending along a circumference thereof to prevent folding of the paper medium coming into contact with the alignment reference surface.

* * * * *